United States Patent [19]

Pichler

[11] Patent Number: 4,793,252

[45] Date of Patent: Dec. 27, 1988

[54] MATRIX LINE PRINTER

[75] Inventor: Josef Pichler, Ebreichsdorf, Austria

[73] Assignee: Mannesmann Tally GmbH, Vienna, Austria

[21] Appl. No.: 514,965

[22] Filed: Jul. 18, 1983

[30] Foreign Application Priority Data

Jul. 3, 1983 [EP] European Pat. Off. ..... 82105951.6

[51] Int. Cl.[4] ..... B41J 3/10

[52] U.S. Cl. ..... 101/93.05; 400/124

[58] Field of Search ..... 101/93.04, 93.05, 93.03; 400/124, 121, 174, 175

[56] References Cited

U.S. PATENT DOCUMENTS

| | | | |
|---|---|---|---|
| 4,077,505 | 3/1978 | Giolitti et al. | 101/93.04 X |
| 4,230,038 | 10/1980 | Hebert | 101/93.05 |
| 4,260,270 | 4/1981 | Cavallan | 101/93.05 X |
| 4,320,981 | 3/1982 | Harrison et al. | 101/93.05 X |
| 4,335,969 | 6/1982 | Ott | 101/93.05 X |
| 4,351,235 | 9/1982 | Bringhurst | 101/93.04 |
| 4,382,701 | 5/1983 | Davenport | 400/124 |
| 4,401,392 | 8/1983 | Blomquist et al. | 400/124 |
| 4,441,828 | 4/1984 | Ochiai et al. | 400/124 |

FOREIGN PATENT DOCUMENTS

| | | | |
|---|---|---|---|
| 0126172 | 7/1983 | Japan | 400/121 |

OTHER PUBLICATIONS

IBM Tech. Disc. Bulletin, "Matrix Printer", Barrekette et al., vol. 20, No. 1, Jun. 1977, pp. 438–439.

*Primary Examiner*—David A. Wiecking
*Assistant Examiner*—James R. McDaniel
*Attorney, Agent, or Firm*—Ralf H. Siegemund

[57] ABSTRACT

A carrier frame is provided for oscillation along a printing platen of the printer and is comprised of two integral, U-shaped sections facing each other at right angles. A plurality of electromagnetic actuators are arranged in one section and include a yoke, a coil, and a pivot armature in each instance. A free end of the pivot armature projects into the other small section. A relatively short print needle is guided in one wall portion of the second section and has its rear end abutment with the projecting end of the armature; an adjusting screw adjusts the relative disposition of the pin-like needle and the armature; the common pivot axis for all armatures is established by a resilient string in a cover plate across the larger U.

8 Claims, 1 Drawing Sheet

MATRIX LINE PRINTER

BACKGROUND OF THE INVENTION

The present invention relates to a matrix line printer having an oscillating frame disposed for movement in front of a platen roller, the frame supporting a plurality of print elements arranged along a line which runs parallel to a line to be printed. The print elements are normally at rest but are movable by means of an energized electromagnet; moreover, the medium to be printed upon is movable after one or several printing passes in a direction transversely to the direction of a line.

Line printers of the type to which the invention pertains have to be distinguished from serial printers as far as the generation of the printing matrix is concerned. Rather than having a plurality of styli arranged in a vertical column and moving the printhead with these styli across the printing medium, i.e., along a line to be printed, the line printers have a plurality of print elements (styli) arranged along the entire length of a line but in spaced-apart relationship, the spacing being "bridged" by oscillating the carrier for the styli as stated. The vertical dimension of any character results from transporting the printing medium in the normal direction of advance, but in small steps. The number of print elements depends, of course, to some extent on the width of the print medium to be covered and may typically involve 30 or more print elements. These print elements as well as their respective drives are arranged in the above-mentioned oscillating frame; and they are arranged, of course, strictly in one line; they have to be moved as a unit in order to cover the entire field and all possible print positions. In particular, printing of columns is not restricted to locations where print elements happen to be in the resting position; but columns are to be printed, more or less, anywhere on the print medium, which is the reason that the oscillatory frame movement has to cover, at least approximately, the distance between two print elements. For dynamic reasons, a significant overshoot is needed.

German printed patent application No. B2 22 24 716 proposes a bar-like carrier element on which electromagnetic coils, each with a core, are mounted. The coils serve as drives for relatively long print needles or wire-like styli, constituting dot-printing elements. The armature of each electromagnetic device is of the plunger variety and is relatively heavy which means that the entire frame arrangment has considerable mass which, in turn, means that driving and retarding forces have to be correspondingly high. In practice, therefore, one may operate only at relatively low oscillating frequencies which, in turn, means that the printer is relatively slow. The problem is compounded by the size of the relatively long print needles which rstricts the print frequency and rate of needle actuation, independently from the heavy weight of the carrier and frame arrangement.

In order to increase the printing frequency, matrix line printers have been suggested (for example, U.S. Pat. No. 3,941,051) in which biased springs "shoot" the print element with point printing tips toward the printing medium; normally, a permanent magnet biases the springs into a deflective position; but by means of an electromagnet, the biasing field is temporarily offset, permitting the spring to relax and propel the print element toward the printing medium. Therefore, the printing speed, as far as the immediate actuation is concerned, depends upon the stored mechanical energy, and requires a very careful choice in the selection of the spring, the magnet, and the other magnetical control elements. Not only has such an arrangement proved to be quite expensive; but it was found also that operating with the principle of stored mechanical energy and bias offsetting a certain interference by magnetic stray flux is to be observed, and these effects retard, to some extent, the printing speed.

DESCRIPTION OF THE INVENTION

It is an object of the present invention to provide a new and improved oscillating frame for line printers, having a very low weight and, therefore, very low mass in order to permit an increase in overall print speed as compared with prior art line printers; the weight reduction, of course, will be effective also to reduce manufacturing cost.

It is another object of the present invention to provide a new and improved actuating and mounting structure for print styli in a line printer, permitting the individual stylus to be very short and, therefore, low weight. Thus, it is a particular feature of the present invention to introduce pins in lieu of long needles.

In accordance with the preferred embodiment of the present invention, it is suggested to provide an electromagnetic actuator with a pivotable armature whose free end bears against a relatively short print stylus or pin. A plurality of such print stylus-magnet combinations are assembled in a frame, having a first, relatively large cross section portion for receiving the magnetic yoke of the electromagnet as well as the energizing coil, and also being closely positioned to one end of the pivotable armature in each instance, while a smaller cross section portion of the frame is provided for receiving a pin or short print stylus, and the free end of the pivot armature projects into the smaller section for engagement of the print stylus; this smaller section also is provided with an adjustment screw for positioning the armature in relation to the print pin or stylus and for adjusting the position of the latter with respect to the plane of printing. It was found, in particular, that a pivotal armature can be arranged with advantage in this manner, particularly when the two sections are constructed each to have a U-shaped cross section, and the two U's are arranged at right angles to each other, one housing the magnetic system, the other one being traversed by the print stylus or pin, and the armature projects, so to speak, from the open space of the section housing the magnetic system into the U of the other section and toward the bottom thereof for engagement with the print stylus or pin as described. In this arrangement, one can use a pin-like low-weight, very short print needle, and the overall space economy is very favorable so that the oscillating frame provided in this manner is of very low weight and of a highly compact construction. As a consequence, the frame can be operated at a higher frequency so that the print speed is increased accordingly. Moreover, the frame can be manufactured in a very economic manner and occupies comparatively little space within the printer as a whole.

DESCRIPTION OF THE DRAWINGS

While the specification concludes with claims, particularly pointing out and dinstinctly claiming the subject matter which is regarded as the invention, it is believed that the invention, the objects and features of the invention, and further objects, features and advantages thereof, will be better understood from the following description taken in connection with the accompanying drawings, in which:

Figure 2:
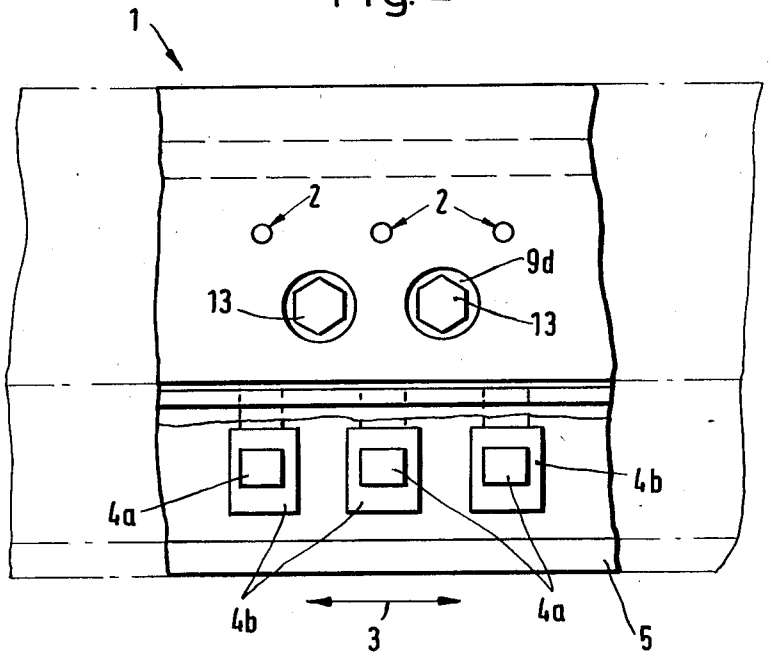
FIG. 2 is a partial front view of the frame shown in FIG. 1, also a portion is shown in section view.
Figure 1:
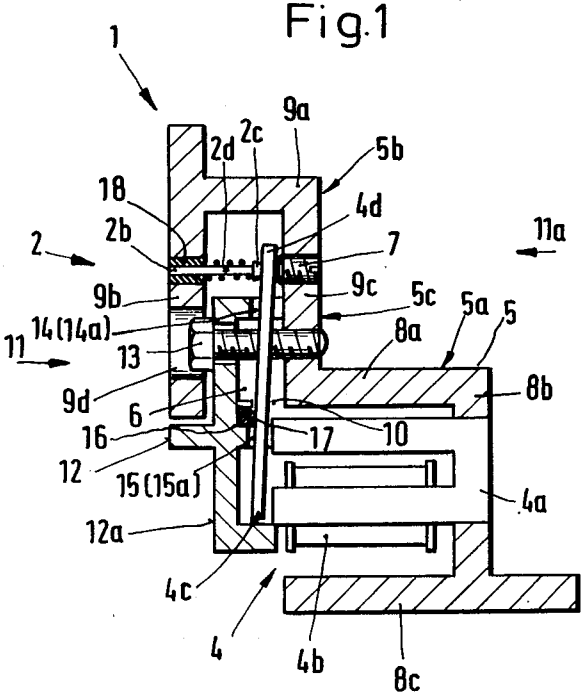
FIG. 1 is a section and side view of an oscillating frame in accordance with the preferred embodiment of the present invention for practicing the preferred mode thereof.

Proceeding now to the detailed description of the drawings, reference numeral 1 refers to an oscillating frame which is provided for movement in a direction perpendicular to the plane of the drawing of FIG. 1 or horizontally in the plane of the drawing of FIG. 2. The oscillating drive is illustrated only schematically and does not per se pertain to the invention. Conventionally, the oscillating drive includes an electromagnetic drive and transmission system which provides essentially a sinosoidal oscillating movement and imparts the same upon the frame 1. The print operation proper occurs essentially during the, more or less linear, portion of this modified sine curve which, of course, means that a considerable overshoot of the frame is required, i.e., the total range of mechanical displacement is larger than actually needed for printing in order to permit the frame to slow down, stop, and reverse. In practice, the minimum, pendulum kind of displacement will amount from 10 mm to 15 mm and covers up to 3-character-width dimensions.

A plurality of pin-like print elements, such as short styli 2, are arranged along a direction of a horizontal print line and in spaced-apart relation, as can be seen from FIG. 2. A single stylus or short, pin-like print needle 2 is visible in FIG. 1. The printing medium, e.g., paper, runs parallel to the plane of the drawing in FIG. 2 and in front of all the styli 2; the direction of paper advance is a vertical one in both figures; that is, perpendicular to the direction of a print line defined by the styli 2. The paper advance, of course, is carried out also in the vertical in FIG. 1; but the sheet extends transversely to the plane of the drawing in FIG. 1.

The printing platen or platen roller is disposed behind the paper and in a corresponding orientation. The platen roller is not shown, its arrangement is conventional; the roller extends transversely to the plane of the drawing of FIG. 1 and is displaced a little to the left of frame 1, as depicted therein. On the other hand, the platen roller extends parallel to the plane of the drawing of FIG. 2, having its closest or very close spacing in the range and opposite the line defined by the several pin-like needles and styli 2.

Each print element and stylus is associated with an electromagnet 4, whereby each magnetic system includes a yoke and core structure 4*a*, an electromagnet coil 4*b*, and a pivot armature 4*c*. The pivotable armature 4*c* is, in each instance, arranged within a profiled or contoured section-like portion 5 of the frame 1. A relatively large, U-shaped cross sectional portion 5*a* houses the yoke structure 4*a* as well as the coil 4*b* and the armature 4*c* of one drive system. These are the essential parts of any electromagnetic arrangement associated with and provided for operating but one stylus 2. Plural such electromagnetic systems are provided in the U-shaped section 5*a*. There are as many magnetic systems as there are styli.

The frame is constructed to have a smaller section-type portion 5*b*, also of U-shaped cross section, and it houses essentially the pins 2. The U's of the two sections 5*a* and 5*b* face each other at right angles and define a communicating portion 6 of the respective open ends of the U's which is traversed by the pivot armature 4*c*. The tip 4*d* of this armature is situated without play between an adjusting screw 7 and the rear end head 2*c* of the particular print pin 2. A compression spring 2*d* bears against thue head 2*c*, having a larger diameter than the stem 2*b* of the needle or pin 2, and a wall portion of section 5*b*. Thus, the spring 2*d* urges the head 2*c* against the armature, and here particularly the upper or tip portion 4*d* thereof, and the latter is urged, thereby, against the adjusting screw 7.

Upon adjusting screw 7, the degree of projection of the pin 2 (or the lack of such a projection) beyond the frame structure can be adjusted. Moreover, the spring holds the pivot armature 4*c* itself in the described abutment position as to the set and adjusting screw 7, which is a retracted position for the armature as far as its participation in the electromagnetic system of the actuator is concerned and for unenergized actuator coils. This retractive position is, therefore, the resting position, and the print needles or pins in each instance are, in fact, retracted thereby.

The complex, section - type frame 5 is comprised, as stated, of the two section portions 5*a* and 5*b* of U-shaped cross section, and it can be seen that each of the sections is composed of three wall sections. Thus, section 5*a* has the three walls 8*a*, 8*b*, and 8*c*, defining its U, while section 5*b* is comprised of the wall sections 9*a*, 9*b*, and 9*c*, defining the smaller U. In each instance, an opening 10 is formed by the respective U shaped of an overall rectangular configuration as to each of the sections in which, so to speak, a short side is missing from each rectangle. Furthermore, sides 9*b* and 8*c* have rearward (or downward) extensions to enhance stiffness.

As a consequence of the arrangement of the U's, a portion 5*c* of frame 5 appears constructed in a stepped manner, particularly as to the side 11*a* not facing the print platen. This then permits that the adjusting screw 7 is easily accessible. Also, this construction provides for an exact position of abutment as far as manufacturing the frame 1 is concerned.

The front side 11, facing the print platen of the framee 1, provided with a supplemental wall-type section 12 which provides broadly for the bearing and pivot support for each of the many pivot armatures 4*c*. There are, of course, as many pivotable armatures as thee are pins for printing. The wall section 12 constitutes an independent, rod-like element that extends in the direction of line to be printed which is the direction as indicated by the arrow 3 in FIG. 2. The wall piece 12 is fastened to wall section 9*c* by means of screws 13. It should be noted, moreover, that the wall section could be comprised of individual elements mounted together or individually to frame 5.

The adjusting screw 7, being provided in fact for adjusting the stroke length of the printing pins, could be located at a lower level, such as in the level of the fastening screw 13. This means that separate fastening screws can be omitted. In other words, adjusting screws cam be provided for combining the fastening fucntion of screw 13 and the adjustment function of the screw 7. Screw 7 is illustrated to be rotatably and adjustably mounted in the wall section 9*c*; but, of course, it could be mounted in the wall section 9*b*. The combined function of fastening and adjustment can likewise be provided by a screw in wall section 9*b* and urging the wall section 12 against wall section 9c. Another way of adjusting the disposition of a pivotable armature 4c is to be seen in providing an adjusting screw of the type of screw 7, but being threaded through and into wall surface 12a of wall 12. The fastening screw 13 as illustrated traverse openings 9d through which they are placed and through which they are accessibly to be released easily.

The wall and frame element 12 bears against the walls of section 9c as well as against one of the legs of the magnetic yoke 4a, respectively by means of projections 14 and 15. These projections have recesses 14a and 15a respectively for the respective pivot armatures, such as 4c. The particular wall surface 12a of section 12 is provided with a groove 16 receiving an elastic string 17 which projects a little above the groove 16 so that the pivot armature 4c is tangentially supported in a manner equivalent to a direct support on an axis of rotation. The armature 4c is preferably guided laterally in the recesses 14a and 15a in a low-friction manner.

One can see that the print needle 2 is very short. The front portion of that needle is received by a sleeve or bushing 18, which is inserted in the wall section 9b. The sleeve or bushing 18 is made of a material which exhibits very low friction and very little wear. In particular, the sleeve 18 may contain a very accurately cut and polished ruby constituting a low-friction bearing proper for the print needle or pin 2. The needles and pins, moreover, are cut plane in the section 9b.

The magnetic yokes are inserted in the larger section 5a, and in a manner planar with the side 11a facing away from the printing platen. One obtains this kind of mounting by forcing the magnetic yokes 4a into the receiving part. This means that the outer bottom of the U-shaped yoke 4a is, in effect, coplanar with the outer side and surface of section part 8b.

Broadly speaking, it can be seen that all important parts are contained within U-shaped portions or sections of the frame 1, being composed of these two sections 5a and 5b accordingly; these sections are combined in a manner that the respective open sides of the U face each other at right angles, and the particular space in between is occupied by the supplemental wall section and part 12. This arrangement optimizes the degree of protection afforded to the various parts, and here particularly the delicate print needles and pins as well as the electromagnetic actuating portion. The frame as a whole, and here particularly the sections 5a and 5b, are preferably made of a rather light-weight metal, i.e., metal having a low specific weight. Construction and arrangement of the two U-shaped sections 5a and 5b and their arrangement and mutual assembly established, as stated above, a stepped contour on the side facing away from the printing platen. This construction is of particular advantage for the purposes of mounting, assembly, and adjustment.

The maintenance work as well as assembly is, moreover, facilitated by the releasable arrangement of wall part 12 serving as a mounting structure for all of the pivotable armatures 4c. Generally speaking, it can be seen that the various wall portions of the various section parts are provided in an advantageous manner as mounting surfaces for the several operating parts of the print pins and their actuating systems. This overall advantage is compounded particularly by the provision of the groove 16, being cut into the releasable wall portion 12. As stated, the elastic string contained therein is akin to a pivot axis. A compact construction is attained, moreover, by the feature mentioned above, in which the outer or lower part of the U-shaped yoke 4a of the magnetic system is flush with one side of the section 5a. Thus, it can be seen that the overall frame construction is very compact, which is, of course, a significant contribution to a low-weight design.

The invention is not limited to the embodiments described above; but all changes and modifications thereof, not constituting departures from the spirit and scope of the invention are intended to be included.

I claim:

1. In a matrix type line printer, the improvement comprising:

a bar like carrier frame provided for oscillation along a printing platen of the printer and being comprised of a first section having a particular cross section and extending predominantly into a first direction and of a second section integral therewith, but offset therefrom and extending predominantly in a transverse direction, each section extending essentially over an entire line to be printed;

a plurality of electromagnetic actuator means arranged in and along the first section in an arrangment parallel to the line to be printed and including a yoke in each instance, a coil, and a pivot armature, a free end of the pivot armature projecting into the second section being smaller in cross section than the first section;

a relatively short, pin-like print needle in the second section being guided in a wall portion thereof and having its rear end in abutment with said free projecting end of the pivot armature; and an adjusting screw for adjusting the relative disposition of the print needle and the armature.

2. The improvement as in claim 1, wherein said first and said second section each are of U-shaped cross section, the two U's being integral and having open ends facing each other at right angles, there being means near the open end of the first section, providing a pivot for said armature.

3. The improvement as in claim 1, said frame being made of a metal of low, specific weight.

4. The improvement as in claim 2, including a releasable wall section across the open end of the U as provided by the first section and including means for providing a bearing for the pivot armature.

5. The improvement as in claim 4, wherein said releasable wall section is provided with a groove, there being an elastic string in the groove projecting beyond the groove, the armature bearing against the string, the string being the pivot.

6. The improvement as in claim 2, wherein the U's are arranged so as to exhibit a stepped contour at the side facing away from the platen.

7. The improvement as in claim 2, wherein said yokes are inserted in the bottom portion of the U of the first section and being flush with the outer wall thereof.

8. The improvement as in claim 1, wherein said second section is of U-shaped configuration, said means for guiding thee needle being provided in one leg of the U and including an inserted guide bushing receiving a front portion of the print needle.

* * * * *